US011697058B1

(12) United States Patent
Hoenigschmid

(10) Patent No.: US 11,697,058 B1
(45) Date of Patent: Jul. 11, 2023

(54) TRIPLE INVERSION GEOMETRIC TRANSFORMATIONS

(71) Applicant: Andreas Hoenigschmid, Los Angeles, CA (US)

(72) Inventor: Andreas Hoenigschmid, Los Angeles, CA (US)

( * ) Notice: Subject to any disclaimer, the term of this patent is extended or adjusted under 35 U.S.C. 154(b) by 0 days.

(21) Appl. No.: 17/821,178

(22) Filed: Aug. 21, 2022

(51) Int. Cl.
*A63F 9/08* (2006.01)
*A63H 33/26* (2006.01)
*A63H 33/04* (2006.01)

(52) U.S. Cl.
CPC ..... *A63F 9/088* (2013.01); *A63H 33/046* (2013.01); *A63H 33/26* (2013.01)

(58) Field of Classification Search
CPC ..... A63F 9/08; A63F 9/088; A63F 9/0826; A63F 9/0865; A63F 9/0869; A63H 33/046; A63H 33/26
USPC ..... 273/155, 156, 157 R, 153 P, 153 S; 446/69, 102, 104, 487, 488
See application file for complete search history.

(56) References Cited

U.S. PATENT DOCUMENTS 1,997,022 A * 4/1935 Stalker ..... A63F 9/088 D11/89
2,570,625 A 10/1951 Zimmerman et al.
2,839,841 A 6/1958 Berry
2,992,829 A 7/1961 Hopkins
3,095,668 A 7/1963 Dorsett
3,254,440 A 6/1966 Duggar
3,618,954 A 11/1971 Murf
3,645,535 A 2/1972 Randolph
3,659,360 A 5/1972 Zeischegg
3,662,486 A 5/1972 Freedman
3,746,345 A 7/1973 Palazzolo
3,831,503 A * 8/1974 Tranquillitsky ..... B65D 19/38 428/542.2
3,916,559 A 11/1975 Flowerday
4,020,205 A 4/1977 Haselbauer
D246,544 S 11/1977 Brinkley
4,063,725 A * 12/1977 Snyder ..... A63F 9/088 273/155
D248,987 S 8/1978 Paschal
4,142,321 A * 3/1979 Coppa ..... A63H 33/16 428/542.2
4,227,334 A * 10/1980 Hooker ..... A63H 33/16 52/80.1
4,258,479 A 3/1981 Roane
D264,361 S 5/1982 Meffert
4,334,870 A 6/1982 Roane
4,334,871 A 6/1982 Roane
4,377,916 A 3/1983 Komiya
(Continued)

FOREIGN PATENT DOCUMENTS

DE 4200184 A1 8/1992
DE 19617526 A1 5/1997
(Continued)

*Primary Examiner* — Joseph B Baldori
(74) *Attorney, Agent, or Firm* — IPkey PLLC

(57) ABSTRACT

Triple inversion geometric transformations are useful as puzzles, toys, teaching aids, therapy devices, and the like. The transformations include a plurality of hingedly connected polyhedrons, each of the polyhedrons having at least one of a first surface, a second surface, or a third surface. The transformations are configurable between three congruent inverted configurations.

20 Claims, 11 Drawing Sheets

(56) References Cited

U.S. PATENT DOCUMENTS

| | | | | |
|---|---|---|---|---|
| 4,392,323 | A | 7/1983 | Rubik | |
| 4,484,406 | A | 11/1984 | Matsumoto et al. | |
| 4,722,712 | A | 2/1988 | McKenna | |
| 4,886,273 | A | 12/1989 | Unger | |
| 5,009,625 | A | 4/1991 | Longuet-Higgins | |
| D321,671 | S | 11/1991 | Goonen | |
| D324,891 | S | 3/1992 | Vershaeve, Jr. et al. | |
| 5,108,100 | A * | 4/1992 | Essebaggers | A63F 9/12 273/159 |
| 5,192,077 | A * | 3/1993 | Caicedo | A63F 9/088 273/155 |
| 5,193,809 | A | 3/1993 | Hrsel et al. | |
| 5,199,711 | A | 4/1993 | Patki et al. | |
| 5,249,966 | A | 10/1993 | Higli | |
| 5,299,804 | A | 4/1994 | Stevens | |
| 5,322,284 | A | 6/1994 | El-Agamawi | |
| 5,429,966 | A | 7/1995 | Wu et al. | |
| D365,295 | S | 12/1995 | Kandampully | |
| 5,630,587 | A * | 5/1997 | Zlotsky | A63F 9/088 446/111 |
| 5,651,715 | A * | 7/1997 | Shedelbower | A63F 9/088 446/490 |
| 5,660,387 | A | 8/1997 | Stokes | |
| 5,746,638 | A | 5/1998 | Shiraishi | |
| 5,762,529 | A * | 6/1998 | Nizza | G09B 25/04 446/124 |
| 6,017,220 | A | 1/2000 | Snelson | |
| 6,024,626 | A | 2/2000 | Mendelson | |
| 6,257,574 | B1 | 7/2001 | Evans | |
| 6,264,199 | B1 | 7/2001 | Schaedel | |
| 6,386,541 | B1 * | 5/2002 | Cornelius | A63F 9/088 273/157 R |
| 6,467,205 | B1 * | 10/2002 | Flagg | G09D 3/00 40/107 |
| D475,094 | S | 5/2003 | Ko | |
| 6,796,560 | B1 * | 9/2004 | Cornelius | A63F 9/088 273/153 R |
| 8,061,713 | B2 | 11/2011 | Cook | |
| 8,087,671 | B2 | 1/2012 | Houlis | |
| 8,157,608 | B1 | 4/2012 | Stapelton | |
| D671,850 | S | 12/2012 | Marzynski | |
| 9,662,592 | B2 | 5/2017 | Haughey et al. | |
| 10,465,376 | B1 * | 11/2019 | Hoberman | E04B 1/35 |
| 10,569,185 | B2 | 2/2020 | Hoenigschmid | |
| 10,918,964 | B2 | 2/2021 | Hoenigschmid | |
| 11,318,370 | B2 * | 5/2022 | Guenzani | A63F 9/1208 |
| 11,358,070 | B2 | 6/2022 | Aberg | |
| 2007/0037469 | A1 | 2/2007 | Yoon | |
| 2008/0224665 | A1 | 9/2008 | Matsumoto et al. | |
| 2008/0274665 | A1 | 11/2008 | Cheng | |
| 2010/0038850 | A1 | 2/2010 | Tenorio | |
| 2010/0087119 | A1 | 4/2010 | Vicentelli | |
| 2010/0120322 | A1 | 5/2010 | Vicentelli | |
| 2010/0225057 | A1 | 9/2010 | Akiyama et al. | |
| 2012/0164913 | A1 | 6/2012 | Pomeroy et al. | |
| 2014/0213139 | A1 | 7/2014 | Ferguson | |
| 2014/0357151 | A1 | 12/2014 | Worley | |
| 2015/0065007 | A1 | 3/2015 | Klepper et al. | |
| 2016/0199749 | A1 | 7/2016 | Whittaker | |
| 2019/0262737 | A1 | 8/2019 | Vicentelli | |
| 2022/0047960 | A1 * | 2/2022 | Hoenigschmid | A63H 33/046 |

FOREIGN PATENT DOCUMENTS

| | | | |
|---|---|---|---|
| FR | 1582965 | A | 10/1969 |
| FR | 2669550 | A1 | 5/1992 |
| GB | 2064844 | A | 6/1981 |
| GB | 2107200 | A | 4/1983 |
| WO | 2013097872 | A1 | 7/2013 |
| WO | 2014038735 | A1 | 3/2014 |

* cited by examiner

TRIPLE INVERSION GEOMETRIC TRANSFORMATIONS

BACKGROUND

Geometric transformations with coupled-together members have enjoyed cross-generational appeal as puzzles, toys, teaching aids, therapy devices, and the like. Such transformations may be configured between different geometric configurations as shown in, e.g., UK Patent Application No. GB 2,107,200 to Asano. However, the geometry and construction of known transformations inherently limits the number and type of geometric configurations which can be achieved. Therefore, a need exists for geometric transformations capable of achieving different configurations and with different properties.

BRIEF SUMMARY

In an aspect, the present disclosure provides geometric transformations which may be inverted (turned inside-out) in three different ways, thus presenting a common polyhedron in each "inverted configuration" but with different outermost surfaces in each of the three instances. For example, representative embodiments include triple inversion geometric transformations which may be manipulated into a common parallelepiped shape (e.g., box) in three different ways such that different outermost surfaces are presented in each instance. As detailed herein, embodiments of such transformations can have a number of interesting properties which enhance their appeal and utility.

In an aspect, the present disclosure provides geometric transformations. The transformations comprise a plurality of hingedly connected polyhedrons, wherein the transformation is configurable between a first inverted configuration, a second inverted configuration, and a third inverted configuration, wherein the first inverted configuration, the second inverted configuration, and the third inverted configuration are congruent. In another aspect, the present disclosure provides methods for manipulating geometric transformations into inverted states.

In any embodiment, each of the hingedly connected polyhedrons may comprise one edge with an edge length of $\sqrt{(3)}$ units, two edges with an edge length of $\sqrt{(2)}$ units, and three edges with an edge length of one unit.

In any embodiment, all outermost surfaces of the first inverted configuration may comprise a first surface ornamentation, all outermost surfaces of the second inverted configuration may comprise a second surface ornamentation, and all outermost surfaces of the third inverted configuration may comprise a third surface ornamentation. The first surface ornamentation, the second surface ornamentation, and the third surface ornamentation may all differ from each other.

In any embodiment, each of the hingedly connected polyhedrons may comprise a first face, a second face, a third face, and a fourth face, wherein the plurality of hingedly connected polyhedrons comprises twelve polyhedrons hingedly connected in a loop, wherein each of the hingedly connected polyhedrons comprises a first magnet disposed adjacent to the first face, wherein the first magnets of adjacent polyhedrons in the loop have opposite polarities.

In any embodiment, each of the hingedly connected polyhedrons may comprise a second magnet disposed adjacent to the second face. The second magnets of adjacent polyhedrons in the loop may have opposite polarities.

In any embodiment, each of the hingedly connected polyhedrons may comprise a third magnet disposed adjacent to the third face. The third magnets of adjacent polyhedrons in the loop may have opposite polarities.

In any embodiment, each of the hingedly connected polyhedrons may comprise a fourth magnet disposed adjacent to the fourth face. The fourth magnets of adjacent polyhedrons in the loop may have opposite polarities.

In any embodiment, outermost surfaces of the first inverted configuration are concealed internal surfaces in the second inverted configuration and the third inverted configuration, outermost surfaces of the second inverted configuration are concealed internal surfaces in the first inverted configuration and the third inverted configuration, and outermost surfaces of the third inverted configuration are concealed internal surfaces in the first inverted configuration and the second inverted configuration.

In any embodiment, each of the hingedly connected polyhedrons may be congruent.

In any embodiment, each of the polyhedrons may be a tetrahedron.

In any embodiment, the first inverted configuration may be a first parallelepiped, the second inverted configuration may be a second parallelepiped, and the third inverted configuration may be a third parallelepiped.

In any embodiment, outermost surfaces of the first inverted configuration may consist of first surfaces, outermost surfaces of the second inverted configuration may consist of second surfaces, and outermost surfaces of the third inverted configuration may consist of third surfaces. The first surfaces, second surfaces, and third surfaces may be mutually exclusive.

In any embodiment, the plurality of hingedly connected polyhedrons may consist of twelve polyhedrons hingedly connected in a loop. Adjacent polyhedrons in the loop may be mirror versions of each other.

In any embodiment, each of the hingedly connected polyhedrons may comprise a first edge and a second edge and may be hingedly connected to a first adjacent polyhedron of the loop along the first edge and to a second adjacent polyhedron of the loop along the second edge. The first edge may be perpendicular to the second edge.

BRIEF DESCRIPTION OF THE SEVERAL VIEWS OF THE DRAWINGS

Representative embodiments are described with reference to the following figures, wherein alike reference numerals refer to alike parts throughout the various views unless otherwise specified.

DETAILED DESCRIPTION

The present disclosure provides geometric transformations (interchangeably referred to as "transformations" herein) comprising hingedly connected polyhedrons, each of which has particular geometric characteristics. Each of the polyhedrons is hingedly connected to other polyhedrons of the transformation and optionally has structural features which enable unique functionality and/or exhibit unique properties of the transformation. As used herein, the term "transformation" means a plurality of hingedly connected polyhedrons.

The transformations described herein have properties which individually and/or collectively enhance the utility and appeal of such transformations as puzzles, teaching aids, therapy devices, and toys. As will be appreciated from the following description, such properties may include any one or more of:

- the ability of the transformation to turn inside out ("invert") three times into three inverted polyhedral configurations ("inverted configurations"), wherein in each inverted configuration, the overall polyhedron presented is congruent with the overall polyhedron in each other inverted configuration
- for each inverted configuration, the outermost surfaces of the polyhedron differ from (e.g., are mutually exclusive from) the outermost surfaces of each other inverted configuration
- for each inverted configuration, the outermost surfaces of the polyhedron have a different appearance and/or texture (surface treatment) from the outermost surfaces of at least one other congruent inverted configuration
- geometric compatibility and magnetic compatibility with other geometric transformations enables the transformations to be assembled with and/or coupled to other transformations As used herein, the term "congruent" means that two geometric figures are identical in shape and size. This includes the case when one of the geometric figures is a mirror image of the other.

Figure 1:
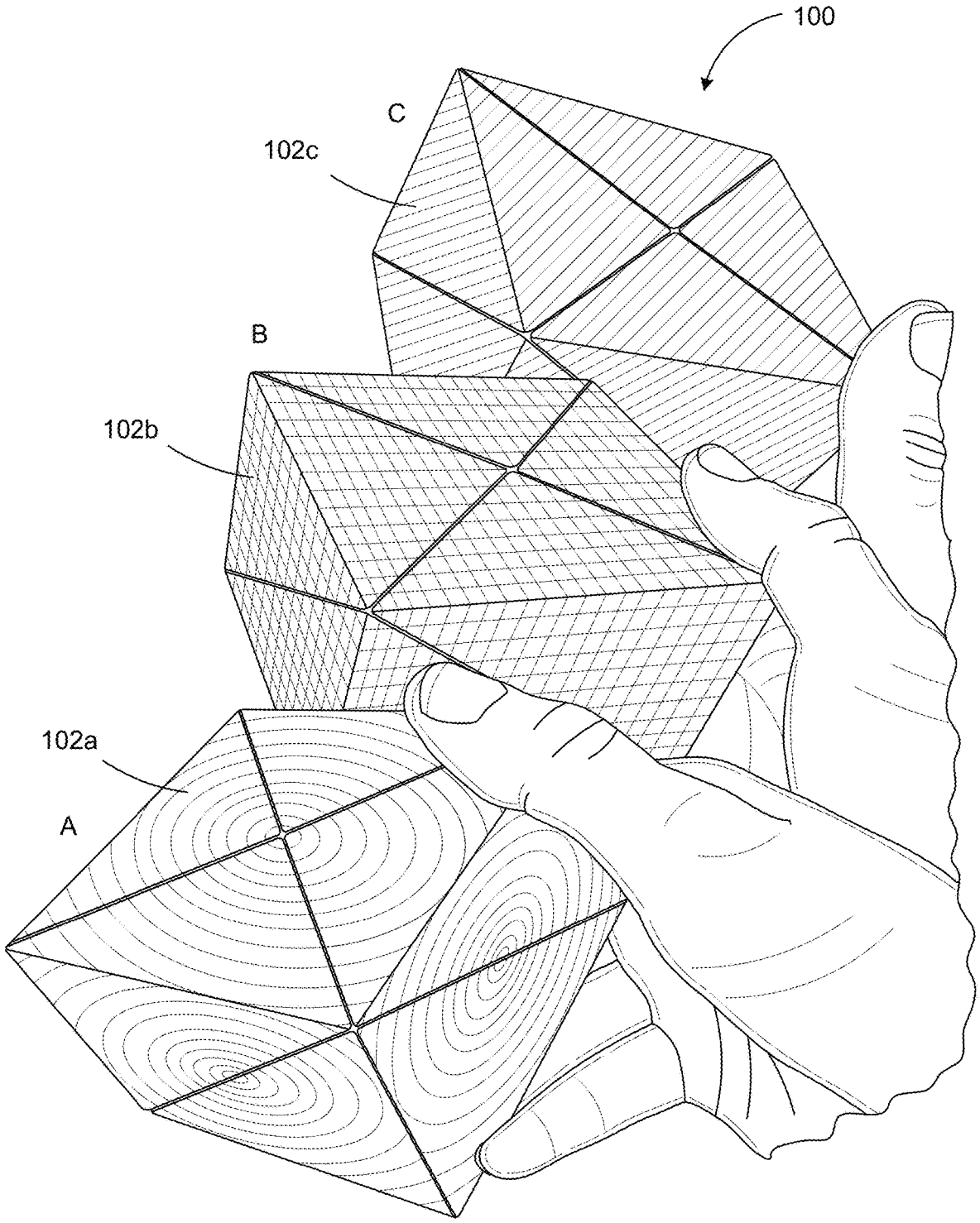
FIG. 1 shows a perspective view of a geometric transformation in three different inverted parallelepiped configurations at three different points in time, according to a representative embodiment of the present disclosure.

FIG. 1 shows a transformation 100 according to a representative embodiment of the present disclosure. As shown, the transformation 100 has a polyhedral shape, form, or configuration (a parallelepiped, in this example). As detailed with respect to FIG. 2-FIG. 5, the transformation 100 comprises a plurality of hingedly connected polyhedrons, which may be manipulated, repositioned, and optionally stabilized (e.g., magnetically) relative to each other to create different overall forms or configurations. In this disclosure, the term "configuration" refers to the shape, form, or configuration of the overall transformation 100, whereas the term "polyhedron" refers to the individual polyhedrons which constitute the transformation 100. Notwithstanding the foregoing, the overall transformation 100 may have a polyhedral configuration.

In particular, FIG. 1 shows the same transformation 100 in three different inverted configurations, A, B, and C, at three different points in time. In each inverted configuration A, B, and C, the transformation 100 has a parallelepiped configuration which is congruent with each of the other parallelepiped configurations. Following from this, the surface area of the outermost surfaces of one of the parallelepiped inverted configurations is equal to the surface area of the outermost surfaces of the other parallelepiped inverted configurations.

As used herein, "inverted configuration" means a configuration of the transformation 100 in which all of the outermost surfaces are internal surfaces in another configuration (e.g., another inverted configuration). As used herein, an "internal surface" is a surface extending through an interior volume of the transformation and is not an outermost surface of the transformation. Internal surfaces may or may not be visible depending on the geometry of the transformation and the materials from which the transformation is constructed. Representative internal surfaces include those shown in FIG. 2a of PCT Publication No. WO/2022/130285, which is herein incorporated by reference in its entirety.

In the example of FIG. 1, the inverted configuration A is an inverted configuration because all of the outermost visible surfaces 102*a* (first surfaces) are concealed as non-visible internal surfaces in the configurations B and C. Likewise, inverted configuration B is an inverted configuration because all the outermost visible surfaces 102*b* (second surfaces) are concealed as internal surfaces in inverted configurations A and C. In the same way, inverted configuration C is an inverted configuration because all the outermost visible surfaces 102*c* (third surfaces) are concealed as internal surfaces in inverted configurations A and B.

The ability of the transformation 100 to achieve three congruent inverted configurations enables interesting possibilities which enhance the utility of the transformation 100. For example, the first surfaces may optionally have a different appearance and/or texture (surface ornamentation) from the second surfaces and/or third surfaces. Similarly, the second surfaces may optionally have a different surface ornamentation from the first surfaces and/or third surfaces. And in some embodiments, the third surfaces may optionally have a different surface ornamentation from the first surfaces and/or second surfaces. The surface ornamentation of any given surface may result from the material from which the particular surface is constructed, application of graphics to the surface, processing the surface to impart a texture, and/or other reason.

Figure 4:
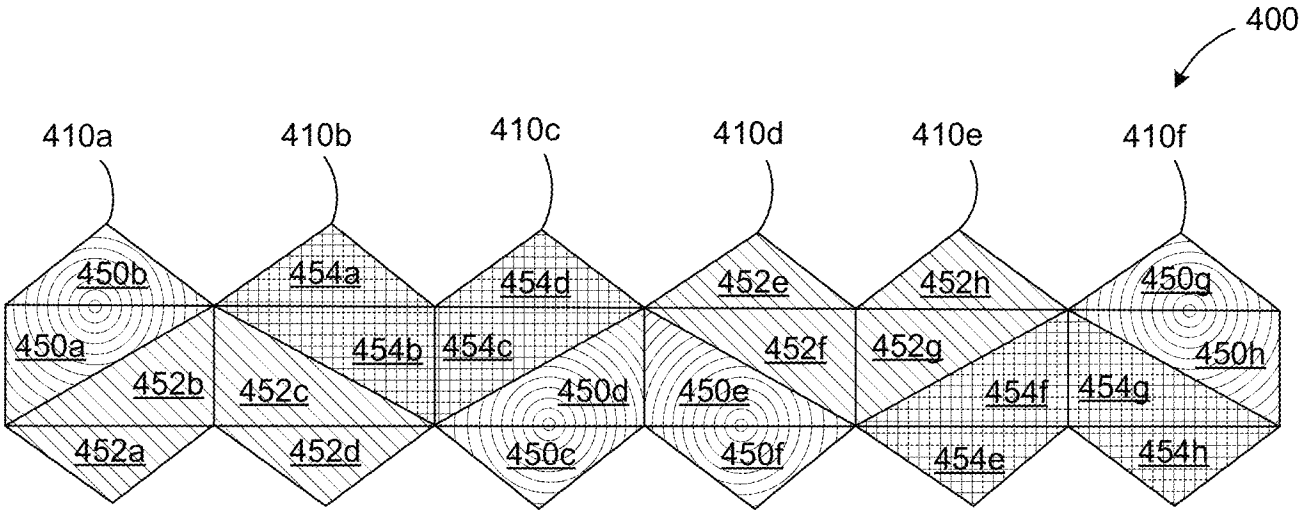
FIG. 4 shows a surface ornamentation schematic of a segment of a geometric transformation, the geometric transformation being the same as that shown in FIG. 1, according to an embodiment of the present disclosure.

In the example of FIG. 1, the first surfaces, second surfaces, and third surfaces have different surface ornamentations, which advantageously enables the transformation 100 to present the same parallelepiped inverted configuration with three different surface ornamentations. FIG. 4 details one representative surface ornamentation arrangement that enables the transformation 100 to present the same parallelepiped inverted configuration with three different surface ornamentations.

Figure 5:
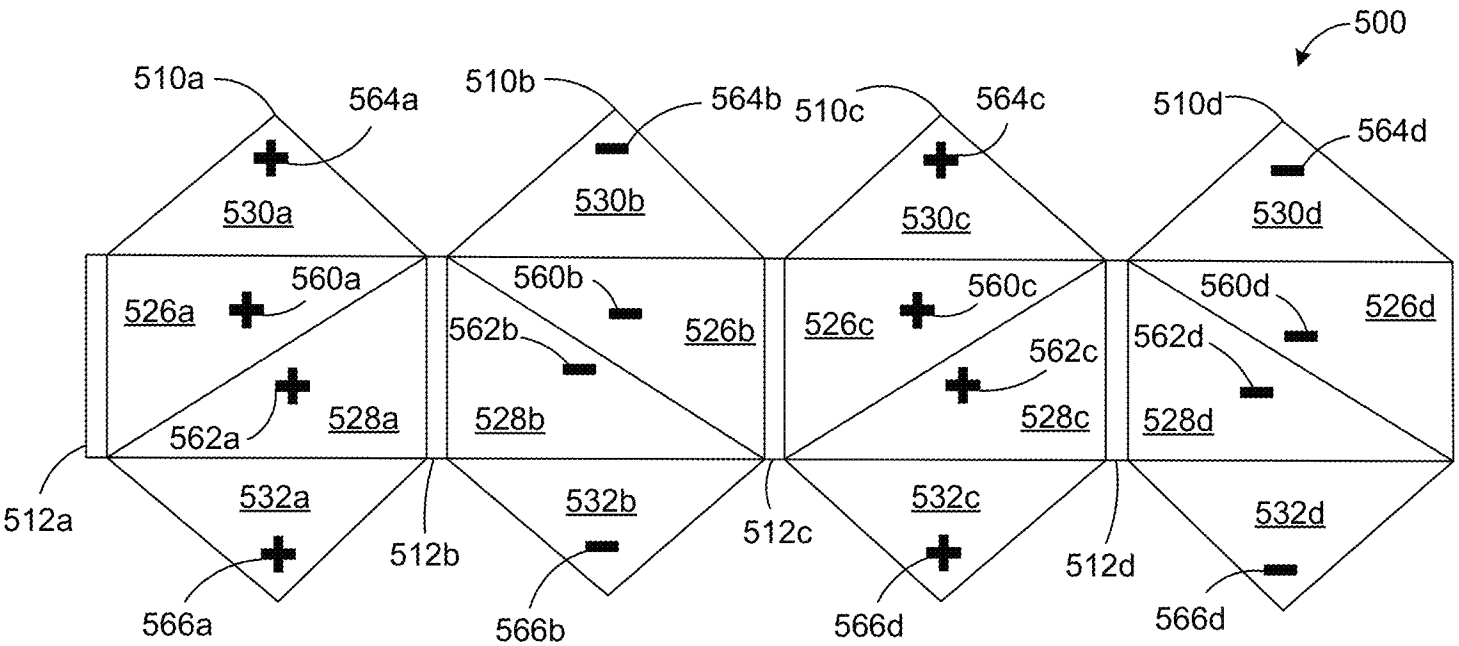
FIG. 5 shows a magnet placement schematic of a segment of a geometric transformation, according to an embodiment of the present disclosure.

In any embodiment, the transformation 100 may include a plurality of optional magnets which are positioned and polarized in configurations that stabilize the transformation 100 in numerous different configurations, including the parallelepiped of FIG. 1. The total number of magnets may vary, e.g., 12, 24, 36, 48, 72, or more. FIG. 5 details one representative magnet configuration configured to stabilize the transformation of FIG. 1 in the parallelepiped inverted configuration.

Figure 2:
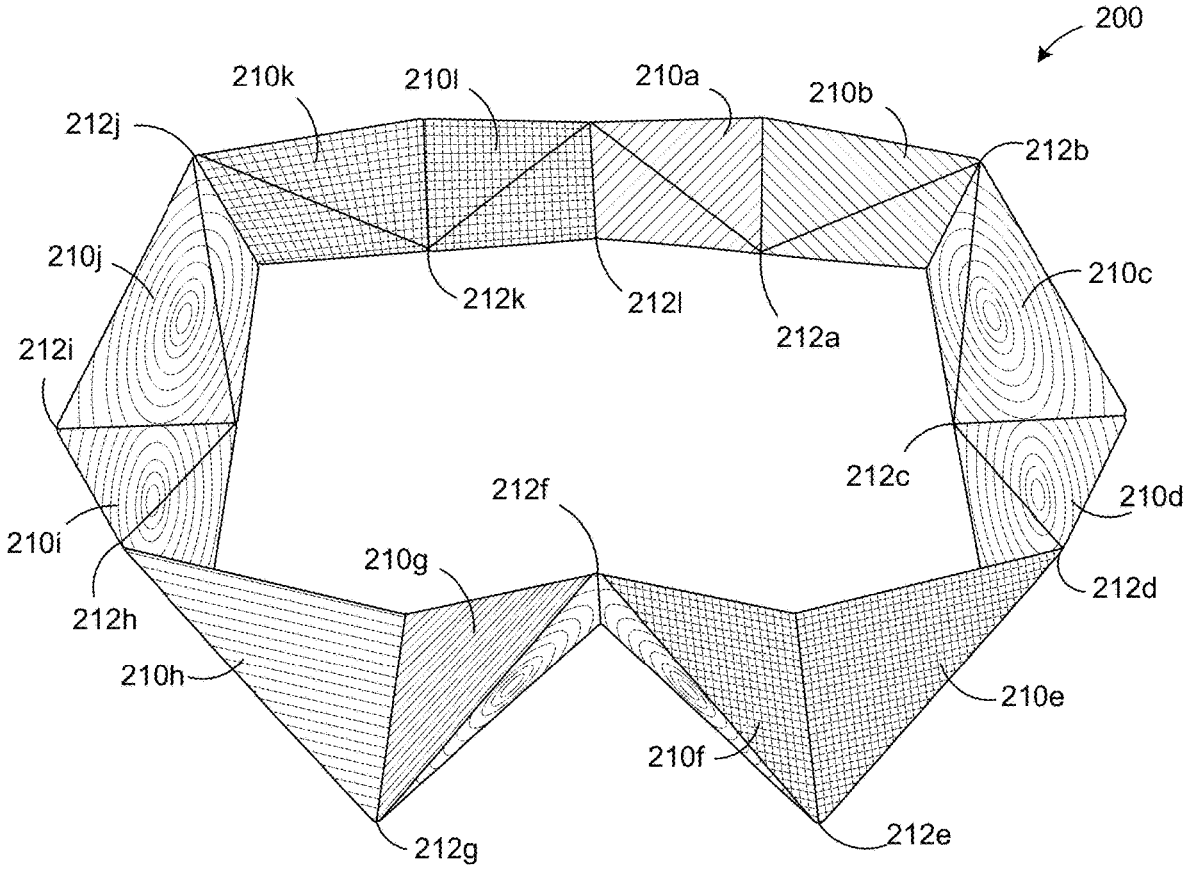
FIG. 2 shows a geometric transformation in a loop configuration, the geometric transformation being the same as that shown in FIG. 1.

FIG. 2 shows a perspective view of a transformation 200 which is the same as the transformation 100 of FIG. 1. The transformation 200 comprises a plurality of polyhedrons 210*a*-1 which are hingedly connected in a continuous loop.

The representative transformation 200 includes twelve polyhedrons, although other embodiments may include a greater number by splitting one or more of the polyhedrons 210*a*-1 into sub-polyhedrons. For example, an embodiment may split each of the polyhedrons 210*a*-1 into two separate, complementary polyhedrons which, when combined, have the same polyhedral shape as the individual polyhedrons 210*a*-1 of FIG. 1. Accordingly, such an embodiment would comprise 24 polyhedrons. In such as fashion, the present disclosure also includes transformations comprising 36, 48, or a greater number of polyhedrons.

Figure 3B:
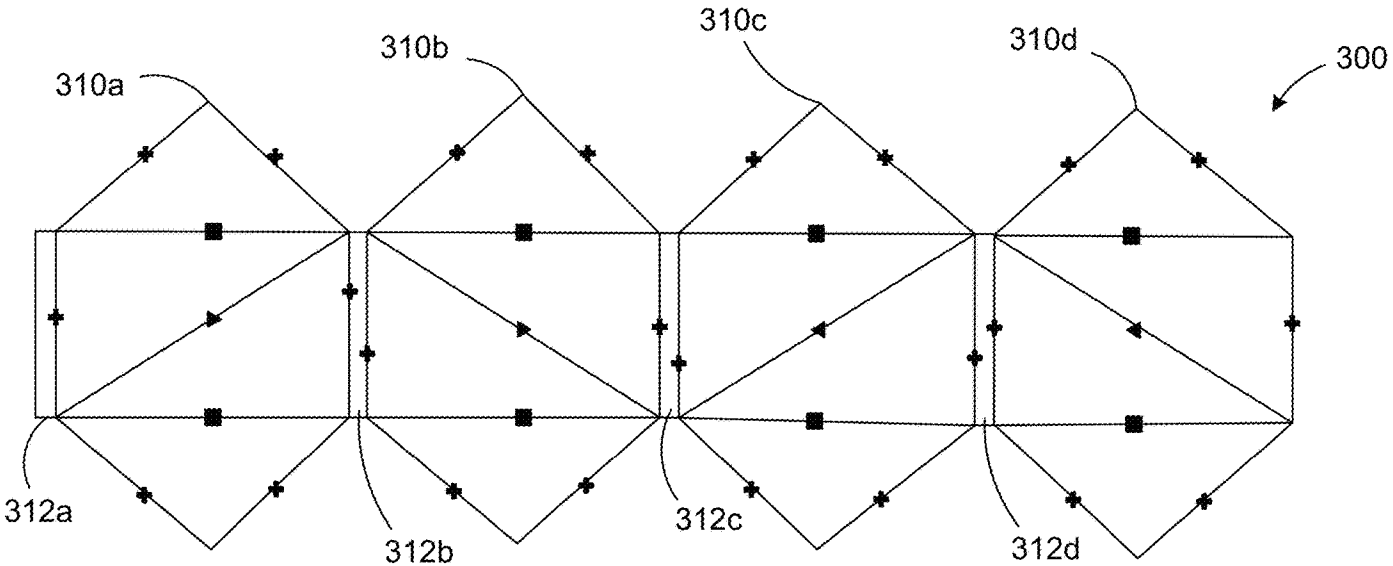
FIG. 3B is a detail view of one polyhedron of the geometric transformation of FIG. 3A.
Figure 3B:
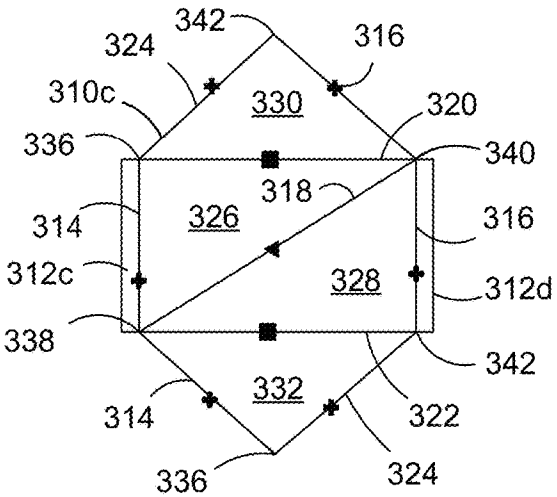
Figure 3A:
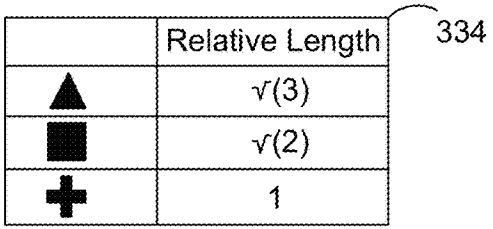
FIG. 3A shows a schematic projection of a segment of a geometric transformation having the same construction and features as the geometric transformations of FIG. 1 and FIG. 2

In the embodiment shown, the polyhedrons 210*a*-1 are congruent and each has a geometry which is detailed in FIG. 3A. The polyhedrons 210*a*-1 are hingedly connected by a plurality of hinges 212*a*-1. In particular, each of the polyhedrons 210*a*-1 is hingedly connected to two adjacent of the polyhedrons 210*a*-1 by two of the hinges 212*a*-1.

In the embodiment shown, each of polyhedrons 210*a*-1 has a solid outer shell with a cavity formed therein. The cavity may be provided with one or more magnets which are positioned and polarized to stabilize the transformation 200 in different configurations (such as the parallelepiped configurations corresponding to the three inverted configurations). One such representative magnet configuration is detailed below with respect to FIG. 5. By way of example, not limitation, the solid outer shell of each of the polyhedrons 210*a*-1 may be formed of a polymer such as high- and low-density polyethylene (LDPE, HDPE), polypropylene (PP), polystyrene (PS, ABS), polyester (PET), or other suitably durable and safe material.

Figure 6A:
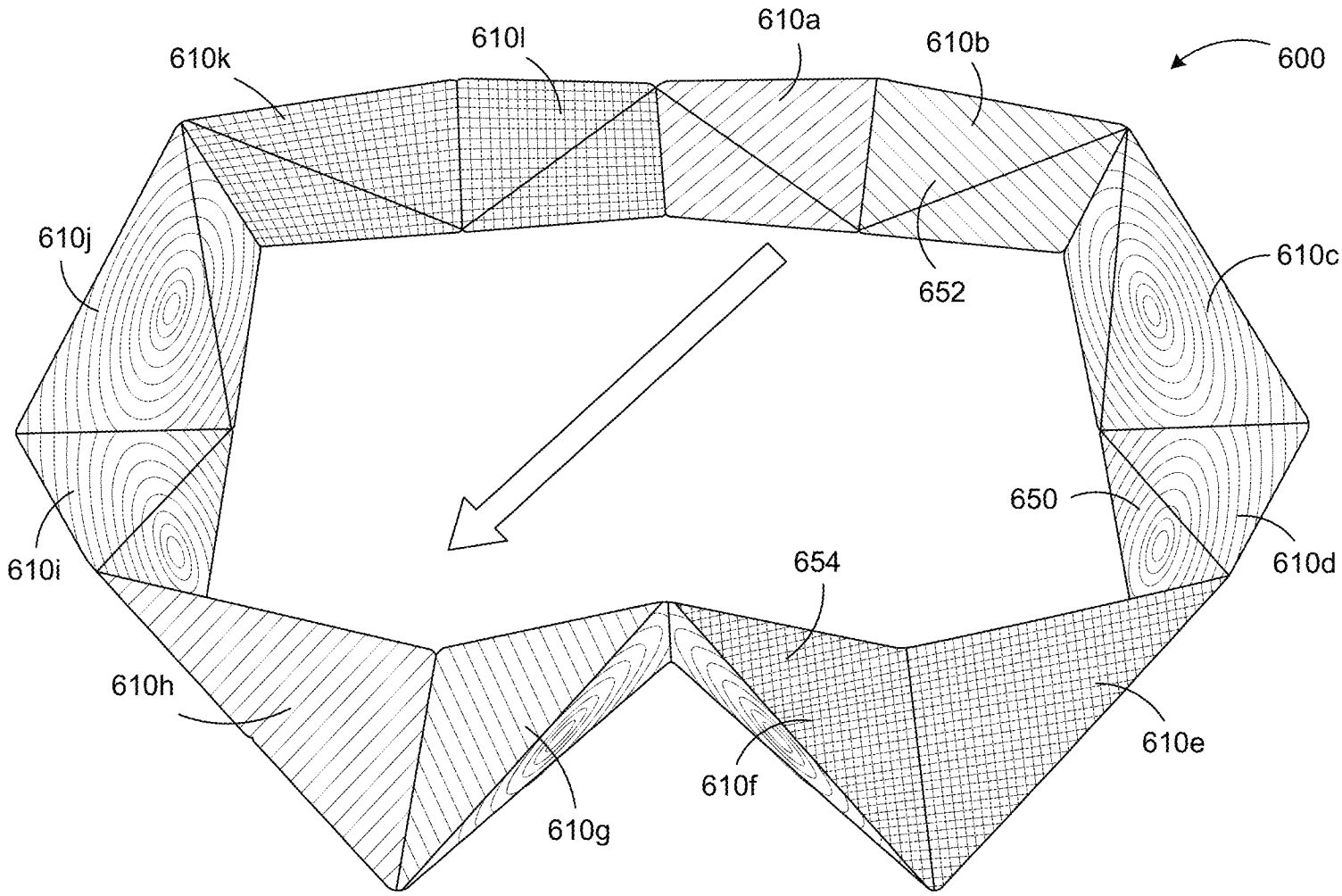
FIG. 6A-FIG. 6F shows a method of manipulating the geometric transformation of FIG. 1 into an inverted configuration, according to a representative embodiment of the present disclosure.
Figure 6B:
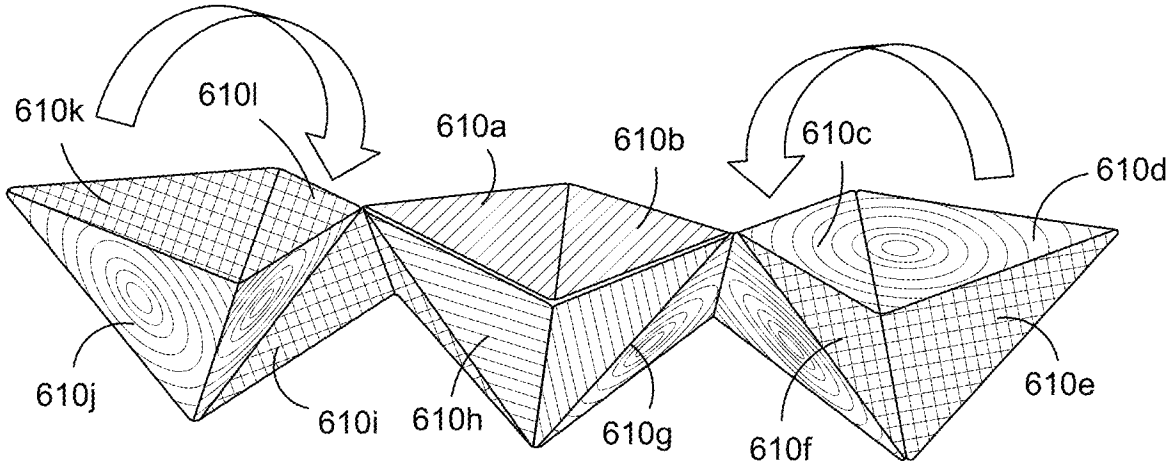
Figure 6C:
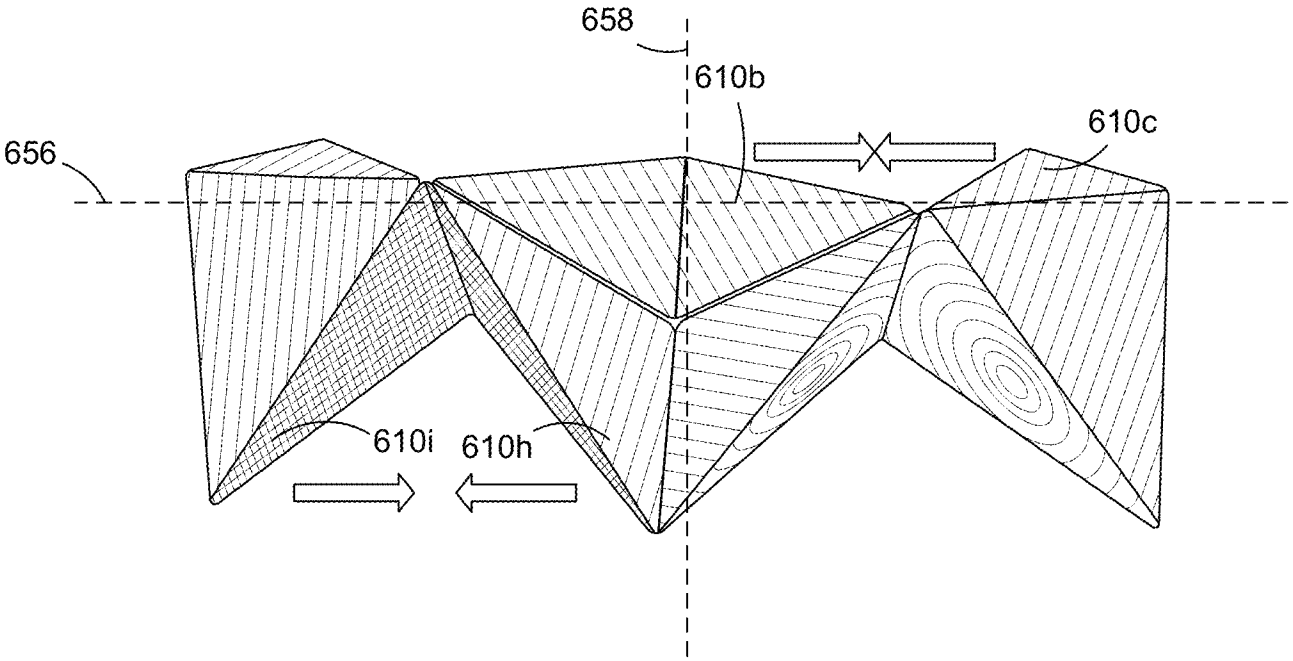
Figure 6D:
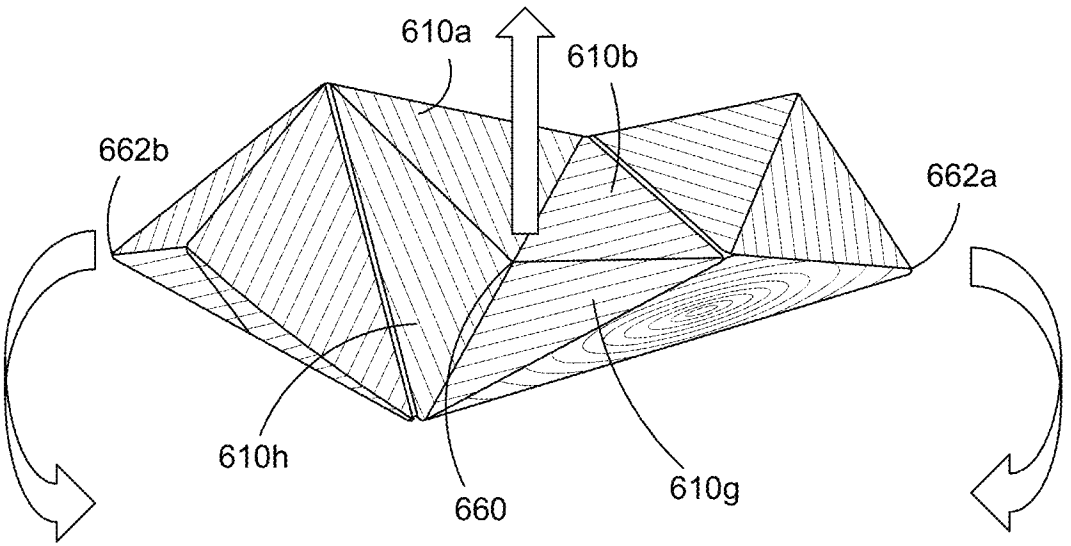
Figure 6E:
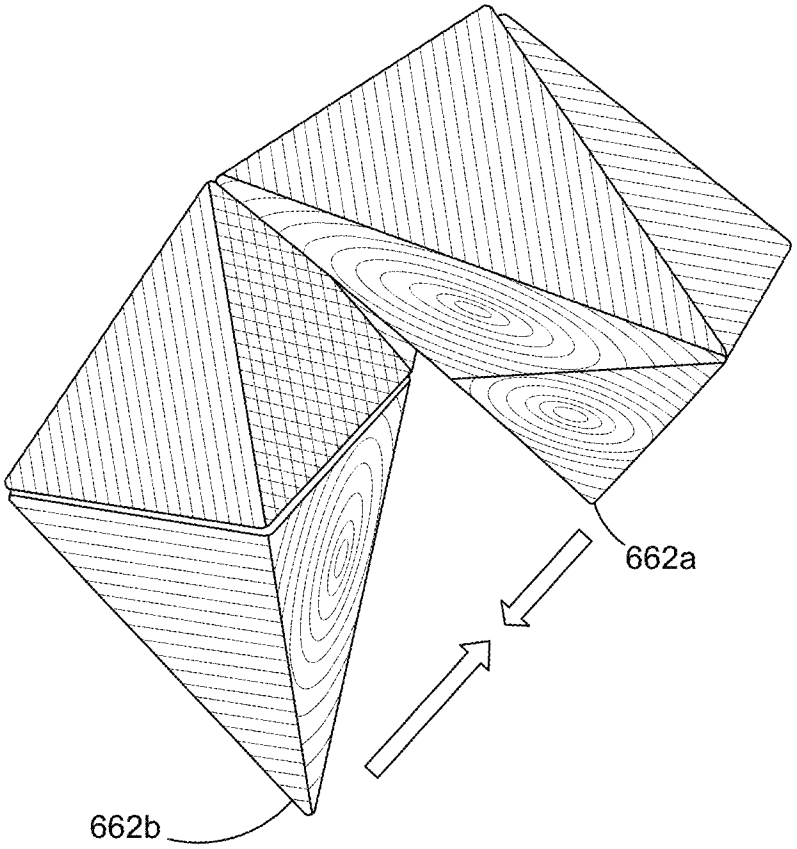
Figure 6F:
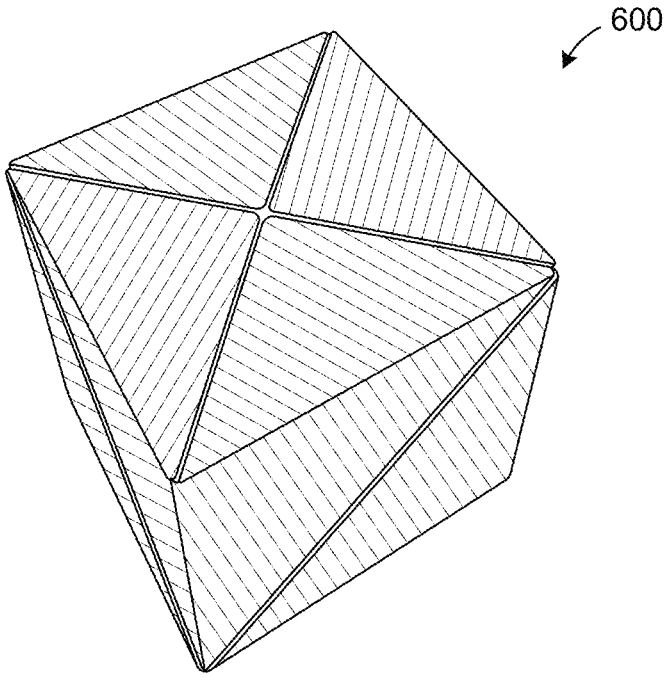

By virtue of the geometry of the polyhedrons 210*a*-1 and the hinged connections 212*a*-1 therebetween, the transformation 100 may be manipulated into numerous different configurations, including the three parallelepiped inverted configurations shown in FIG. 1 and FIG. 6F as well as the intermediate configurations of FIG. 2, and FIG. 6A-E.

As is apparent from FIG. 2, each of the polyhedrons 210*a*-1 may be provided with surface ornamentation such as graphics, texture, color, and the like. As can be appreciated from FIG. 1, the coordinated placement of different surface ornamentations enables the transformation 100 to present each of the different surface ornamentations in each inverted configuration. FIG. 4 details one such surface ornamentation arrangement.

FIG. 3A is a schematic projection of a transformation segment 300 having the same construction and features as segments of the geometric transformations of FIG. 1 and FIG. 2. Specifically, the transformation segment 300 includes four hingedly-connected polyhedrons 310*a-d*, each of which corresponds to one of the polyhedrons of the transformations 100, 200. Restated, each of the polyhedrons of the transformations 100, 200 has geometry corresponding to the polyhedrons 310*a-d*.

Three of the four-polyhedron transformation segments 300 may be hingedly connected in an end-to-end continuous loop to achieve the twelve-polyhedron transformations 100, 200 of FIG. 1 and FIG. 2. The polyhedrons 310*a-d* are hingedly coupled together by hinges 312*b-d*, and hinge 312*a* is configured to couple polyhedron 310*a* to another adjacent polyhedron or transformation segment (not shown). FIG. 3B is a detail view of FIG. 3A showing details of polyhedron 310*c* and hinges 312*c, d*.

The geometry of the polyhedrons 310*a-d*, together with the hinged couplings therebetween, enable the geometric transformations of the present disclosure to be manipulated into the configurations shown and described herein. Accordingly, FIG. 3A and FIG. 3B illustrate one representative geometry and hinge configuration. However, the specific geometry and coupling arrangement shown in FIG. 3A and FIG. 3B is representative, not limiting.

The geometry of FIG. 3A may be achieved with a greater number of polyhedrons and with different hinging arrangements. For example, each of the polyhedrons 310*a-d* may be split into two or more sub-polyhedrons as described above. As an example of a different hinging arrangement, two polyhedrons may be hingedly connected with two hinges, rather than a single hinge as shown in FIG. 3A. Nevertheless, it shall be appreciated that of all possible theoretical geometries of the polyhedrons 310*a-d*, very few of such geometries would enable a geometric transformation comprising three of the transformation segments 300 connected in an end-to-end continuous loop to achieve three congruent inverted configurations. For at least this reason, the geometries described herein are not obvious variants of known geometries.

As shown, each of the polyhedrons 310*a-d* in the illustrated embodiment is a tetrahedron having four faces, six edges, and four vertices, just as with the polyhedrons of the geometric transformations shown in FIG. 1 and FIG. 2. The projection of the three-dimensional tetrahedral shape onto the two-dimensional plane in FIG. 3A and FIG. 3B duplicates three edges, hence the appearance of nine edges in the schematic of FIG. 3A and FIG. 3B. However, the skilled artisan shall appreciate this characteristic of the projection, which is further clarified below.

FIG. 3B details edge, face, and vertex details of representative polyhedron 310*c*, which is congruent with polyhedrons 310*a-b* and *d*. Polyhedrons 310*a* and *c* are mirror images or mirror versions of polyhedrons 310*b* and *d*.

As shown, polyhedron 310*c* comprises six edges which define four faces having four vertices. In particular, polyhedron 310*c* comprises a first edge 314, a second edge 316, a third edge 318, a fourth edge 320, a fifth edge 322, and a sixth edge 324. Although shown in a two-dimensional projection in FIG. 3A and FIG. 3B, the geometry of the polyhedron 310*c* dictates that the first edge 314 is perpendicular to the second edge 316 in the three-dimensional embodiment of the polyhedrons (as shown in FIG. 2).

The first edge 314, third edge 318, and fourth edge 320 define a first face 326. The second edge 316, third edge 318, and fifth edge 322 define a second face 328. The second edge 316, fourth edge 320, and sixth edge 324 define a third face 330. The first edge 314, fifth edge 322, and sixth edge 324 define a fourth face 332. The first face 326 has a first vertex 336, a second vertex 338, and a third vertex 340. The second face 328 has the second vertex 338, third vertex 340, and a fourth vertex 342. The third face 330 has the first vertex 336, third vertex 340, and fourth vertex 342. The fourth face has the first vertex 336, second vertex 338, and fourth vertex 342.

The first face 326 is congruent with the second face 328. The third face 330 is congruent with the fourth face 332. Each of the first face 326, second face 328, third face 330, and fourth face 332 are right triangles. Further, the third face 330 and fourth face 332 are isosceles triangles.

The relative lengths of the six edges will now be detailed with reference to the legend 334, which is applicable to both FIG. 3A and FIG. 3B. It shall be appreciated that while edge length is described below, such description aptly describes distances between the corresponding vertexes. Accordingly, the following description of "edge length" does not limit the present disclosure to geometric transformations having tetrahedral polyhedrons with six continuous, linear, unbroken, edges. Indeed, the present disclosure includes geometric transformations formed of polyhedrons having discontinuous and/or non-linear edges so long as such polyhedrons have vertices corresponding to those shown in FIG. 3B with relative distances therebetween as defined in legend 334.

Each of the six edges of each polyhedron 310*a-c* has a relative edge length (alternatively, vertex distance) indicated by the symbol thereon, which corresponds to the relative edge length defined in the legend 334. In particular, first edge 314, second edge 316, and sixth edge 324 (bearing a plus symbol) have a relative edge length of 1 unit, and in some embodiments (e.g., the embodiment shown) are the only edges having a relative edge length of 1 unit. Third edge 318 (bearing a triangle symbol), the longest edge of the polyhedron 310*c*, has a relative edge length of √(3) units (square root of three units), and in some embodiments (e.g., the embodiment shown) is the only edge having such an edge length. Fourth edge 320 and fifth edge 322 (bearing a square symbol) have a relative edge length of √(2) units (square root of two units), and in some embodiments (e.g., the embodiment shown) are the only edge having such an edge length.

The edge lengths shown are relative and may be scaled up or down as long as the relative lengths between the six edges remain constant. For example, in a representative embodiment, the base unit is 10 cm. In such an embodiment, the first edge 314, second edge 316, and sixth edge 324 would have an edge length of 10 cm. According to the relationship defined in the legend 334, the third edge 318 (the longest edge) would have an edge length of 10√(3)cm=17.32 cm, and the fourth edge 320 and fifth edge 322 would have an edge length of 10√(2)cm=14.14 cm. In another representative embodiment in which the base unit is 20 cm, each edge length would be twice as long as the previously defined embodiment. Accordingly, the relative edge lengths (alternatively, vertex distances) defined by the legend 334 may be proportionately scaled up or down.

Returning to FIG. 3A, two additional features of the transformation segment 300 are apparent. First, each polyhedron is a mirror image of the two adjacent polyhedrons. For example: polyhedron 310*b* is a mirror image of polyhedrons 310*a* and *c*; polyhedron 310*c* is a mirror image of polyhedrons 310*b* and *d*, and so on. This property enables alike edges of adjacent polyhedrons to be hingedly connected as described below. Accordingly, although all of the polyhedrons are congruent, there are two types which are mirror images of each other, i.e., type one polyhedrons (e.g., polyhedrons 310*a, c*) and type two polyhedrons (e.g., polyhedrons 310*b, d*). In terms of geometry, the transformation segment 300 includes a repeating alternating pattern comprising: a type one polyhedron, a type two polyhedron, a type one polyhedron, and so on.

The second property apparent from FIG. 3A is that adjacent polyhedrons are hingedly coupled together along alike edges by hinges 312*a-d*. For example, referring to FIG. 3A and FIG. 3B together, hinge 312*c* hingedly connects the first edge 314 of polyhedron 310*c* to the corresponding first edge of mirror image polyhedron 310*b*. Similarly, hinge 312*d* hingedly connects the second edge 316 of polyhedron 310*c* to the corresponding edge of mirror image polyhedron 310*d*.

The hinged or flexible connections enable the polyhedrons to be manipulated relative to each other such that the geometric transformation can achieve different configurations (such as the parallelepiped configurations of FIG. 1) as well as the configurations shown in FIG. 2 and FIG. 6A-FIG. 6E while the whole geometric transformation remains a singular apparatus, rather than an uncoordinated assortment of parts.

The polyhedrons of the geometric transformations described herein are generally assembled such that the corresponding edges (immediately adjacent edges) of adjacent polyhedrons abut or have a separation of less than 1 mm, e.g., 0.5 mm. This is evident from FIG. 2, which shows the transformation 200 and its representative hinged connections between adjacent polyhedrons.

The hinges 312*a-d* may take many different forms. In some embodiments, each of the hinges 312*a-d* is a decal or sticker applied to the faces of at least two adjacent polyhedrons (e.g., the mirror image faces of adjacent polyhedrons) such that the hinge extends from one of the polyhedrons directly to another polyhedron. For example, referring to FIG. 3A, if hinge 312*c* had such construction, then the hinge 312*c* would be a decal applied at least to first face 326 of polyhedron 310*c* and extending to the adjacent, mirror image face of polyhedron 310*b*, thus hingedly connecting the adjacent polyhedrons along first edge 314 of polyhedron 310*c*. In some such embodiments, the decal may comprise more than one hinge. For example, in an embodiment, a single continuous decal is applied to polyhedrons 310*a-d* and accordingly comprises at least hinges 312*b-d*. Representative hinges of this configuration are detailed in U.S. Pat. Nos. 10,569,185 and 10,918,964, which are herein incorporated by reference in their entireties.

In other embodiments, the hinges are formed integrally with the polyhedrons and extend directly from one of the polyhedrons to an adjacent polyhedron. In such embodiments, the hinges may be formed as a flexible polymer strip of a same or similar material as the outer shell of the polyhedrons. For example, referring to FIG. 3A, if hinge 312*c* had such construction, then the hinge 312*c* would be integrally formed with polyhedrons 310*b, c* as at least one strip of polymer extending between polyhedrons 310*b, c*, thereby coupling the adjacent polyhedrons along first edge 314 of polyhedron 310*c*. Representative hinges of this configuration are detailed in U.S. Pat. No. 11,358,070, which is herein incorporated by reference in its entirety.

In still other embodiments, the hinges are formed as one or more internal flexible connection strips (e.g., of a thin flexible polymer or textile) extending between adjacent polyhedrons and configured to be anchored within internal cavities of adjacent polyhedrons. For example, referring to FIG. 3A, if hinge 312*c* had such construction, then one portion of hinge 312*c* would be anchored within an internal cavity of polyhedron 310*b*, and another portion of the hinge 312*c* would be anchored with an internal cavity of polyhedron 310*c*, thereby coupling the adjacent polyhedrons along first edge 314 of polyhedron 310*c*. Representative hinges of this configuration are detailed in PCT Publication No. WO 2022/030285, which is herein incorporated by reference in its entirety.

In any embodiment, more than one hinge may extend between adjacent edges of adjacent polyhedrons. The foregoing hinge structures are representative, not limiting.

From this description and the geometry of the polyhedrons 310*a-d*, it is apparent that adjacent hinges are perpendicular to each other by virtue of the perpendicular relationship between the first edge (e.g., first edge 314) and the second edge (e.g., second edge 316). For example, hinge 312*c* is perpendicular to hinge 312*d*. This is evident from FIG. 2.

The geometry and hinges described above enable the geometric transformations of the present disclosure to achieve three inverted configurations, e.g., the three parallelepipeds shown in FIG. 1. For example, the geometry described herein enables a first hinge of each polyhedron (e.g., hinge 312*c* in the instance of polyhedron 310*c*) to have a perpendicular orientation relative to a second hinge of the same polyhedron (e.g., hinge 312*d*). Restated, each polyhedron has a first hinge oriented along an x-direction and a second hinge oriented along an orthogonal y-direction. Further, the geometry described herein enables the geometric transformations of the present disclosure to form a same parallelepiped inverted configuration in three different ways, wherein each face of the parallelepiped inverted configuration comprises either a) four isosceles triangular faces of four different polyhedrons (each corresponding to either the relatively small third face 330 or fourth face 332) or b) two right triangular faces of two different polyhedrons (each corresponding to either the relatively large first face 326 or second face 328).

Geometric transformations of the present disclosure may include additional, optional features which enhance the ability of the transformation to exhibit certain properties, which make the transformation more engaging as a teaching tool or puzzle, or otherwise make the transformation more appealing.

To exhibit the triple inversion capabilities of the geometric transformations of the present disclosure, different surface ornamentations may be selectively provided on certain surfaces of the polyhedrons. Specifically, certain surfaces of the polyhedrons may be selectively provided with different surface ornamentations to exhibit the property that all outermost surfaces of one inverted configuration are completely concealed as internal surfaces in the other two inverted configurations. Otherwise, a user might not appreciate the triple inversion capabilities of the geometric transformations.

As used herein, a surface ornamentation differs from another surface ornamentation if, for example, it has a different color, pattern, surface texture, graphical theme, orientation, or other property which imparts a different appearance and/or tactile feel from another surface ornamentation. On the other hand, a surface ornamentation is not limited to a single color or texture and may include a coordinated theme which nevertheless has different portions with different colors or textures (e.g., a repeating motif). Any given surface ornamentation may result from the material from which the surface is constructed, application of colors, graphics, decals, stickers, and the like to the surface, and/or a texture of the surface.

FIG. 4 schematically illustrates one optional and representative surface ornamentation arrangement which exhibits the triple inversion capabilities of the geometric transformations. However, the illustrated embodiment is representative, not limiting.

FIG. 4 (like FIG. 3A) is a schematic projection of a transformation segment 400. Specifically, the transformation segment 400 includes six hingedly-connected polyhedrons 410*a-f*, each of which has four faces and which may have the geometry of the polyhedrons of the transformation segment 300 of FIGS. 3A-B. Two of the transformation segments 400 having the geometry of FIGS. 3A-B may be hingedly connected in an end-to-end continuous loop to achieve the twelve-polyhedron transformations 100, 200 of FIG. 1 and FIG. 2. It shall be appreciated that the polyhedrons 410*a-f* are hingedly coupled together (e.g., by hinges as shown in FIGS. 3A-B), which are omitted from FIG. 4 for brevity.

The transformation segment 400 is described with reference to "first surfaces," "second surfaces," and "third surfaces," which are respectively the outermost surfaces in first, second, and third inverted configurations of a geometric transformation formed of two of the segments 400 having the geometry of FIGS. 3A-B hingedly connected in an end-to-end continuous loop to achieve the twelve-polyhedron transformations 100, 200 of FIGS. 1-2.

In particular, segment 400 is described with reference to first surfaces 450*a-h*, second surfaces 452*a-h*, and third surfaces 454*a-h*. First surfaces 450*a-h* are the outermost surfaces of a first inverted configuration (e.g., the visible surfaces of parallelepiped inverted configuration A of FIG. 1) but concealed as internal surfaces in the second and third inverted configurations (e.g., inverted configurations B and C of FIG. 1). Second surfaces 452*a-h* are the outermost surfaces of the second inverted configuration (e.g., the visible surfaces of parallelepiped inverted configuration B of FIG. 1) but concealed as internal surfaces in the first and third inverted configurations. Third surfaces 454*a-h* are the outermost surfaces of the third inverted configuration (e.g., inverted configuration C of FIG. 1), but concealed as internal surfaces in the first and second inverted configurations. Restated, outermost surfaces of the first inverted configuration consist of first surfaces 450*a-h*, outermost surfaces of the second inverted configuration consist of second surfaces 452*a-h*, and outermost surfaces of the third inverted configuration consist of third surfaces 454*a-h*.

In some embodiments, the first surface ornamentation differs from the second surface ornamentation and/or the third surface ornamentation in order to exhibit the triple inversion capabilities of the transformation. In the embodiment of FIG. 4, first surfaces 450*a-h* bear concentric circles, second surfaces 452*a-h* bear parallel lines, and third surfaces 454*a-h* bear parallel and perpendicular lines.

Although the polyhedrons of the segment 400 may have the same geometry as the polyhedrons of the segment 300 of FIGS. 3A-B, the term "surface" used to describe the first surfaces, second surfaces, and third surfaces of FIG. 4 does not correspond to the term "face" used to describe the geometry of the polyhedrons of FIG. 3A and FIG. 3B. For example, the geometry of the tetrahedral polyhedrons 410*a-f* dictates that each polyhedron has a first face, second face, third face, and a fourth face; however, none of the polyhedrons 410*a-f* have all of first surfaces, second surfaces, and third surfaces. Indeed, each of the polyhedrons 410*a*-1 in FIG. 4 has only two types of surfaces: first surfaces and second surfaces; first surfaces and third surfaces, or second surfaces and third surfaces. In other words, according to the surface ornamentation arrangement of FIG. 4, each polyhedron 410*a-f* has surfaces which are outermost (visible) surfaces in only two of the three inverted configurations.

As shown, each of the polyhedrons 410*a-f* comprises two different types of surfaces. Polyhedrons 410*a, d* comprise first surfaces and second surfaces in the relative locations shown; polyhedrons 410*b, e* comprise second surfaces and third surfaces; and polyhedrons 410*c, f* comprise first surfaces and third surfaces. Hingedly connecting two such transformation segments 400 in an end-to-end continuous loop (provided that each of the polyhedrons has the geometry shown in FIGS. 3A-B) enables the resulting geometric transformation to present only first surfaces 450*a-h* in the first parallelepiped inverted configuration; only second surfaces 452*a-h* in the second parallelepiped inverted configuration; and only third surfaces 454*a-h* in the third parallelepiped inverted configuration. Advantageouly, this helps the user and/or observers appreciate when the transformation is in the different inverted configurations.

The foregoing surface ornamentation arrangement is representative, not limiting. For example, in other embodiments, the first surfaces and the second surfaces may have a same or coordinated surface ornamentation which differs from the third surfaces; such a configuration would present the same or coordinated surface ornamentation in two different inverted configurations, but not the third. In still other embodiments, the first surfaces, second surfaces, and third surfaces all have a same or coordinated surface ornamentation.

As another optional feature, any geometric transformation of the present disclosure may include magnets which are positioned and polarized to stabilize the transformation in the inverted configurations and intermediate configurations, including those shown in FIG. 6A—FIG. 6F.

FIG. 5 shows one representative magnet arrangement in a transformation segment 500, according to an embodiment of the present disclosure. Like FIG. 3A and FIG. 4, FIG. 5 is a schematic projection, and the transformation segment 500 has the same construction and features as segments of the geometric transformations of FIG. 1 and FIG. 2. Specifically, the transformation segment 500 includes four hingedly-connected polyhedrons 510*a-d*, each of which corresponds to one of the polyhedrons of the transformations 100, 200 and each of which may have the geometry shown in FIGS. 3A-B.

Three of the transformation segments 500 may hingedly connected in an end-to-end continuous loop to achieve the twelve-polyhedron transformations 100, 200 of FIG. 1 and FIG. 2. The polyhedrons 510*a-d* are hingedly coupled together by hinges 512*b-d*, and hinge 512*a* is configured to couple polyhedron 510*a* to another adjacent polyhedron (not shown).

In some embodiments, at least some of the magnets are positioned and polarized such that hingedly coupled faces of adjacent polyhedrons can magnetically couple when positioned adjacent to each other. For example, polyhedrons 510*a, b* are provided with magnets which are positioned and polarized such that second face 528*a* of polyhedron 510*a* can magnetically couple with second face 528*b* of polyhedron 510*b*.

In some embodiments, at least some of the magnets are positioned and polarized such that mirror image faces of non hingedly-connected polyhedrons magnetically couple when positioned adjacent to each other. For example, referring briefly to FIG. 2, magnets may be provided on isosceles faces of polyhedron 210*a* and *h* such that those faces magnetically couple together in certain configurations (such as the configuration shown in FIG. 6B).

Consistent with these goals, one representative magnet arrangement will now be described.

Each of polyhedrons 510*a-d* includes a plurality of magnets, i.e., at least one magnet positioned adjacent to each face such that a magnetic field from that magnet extends through the face adjacent to which the magnet is placed. For example, polyhedron 510*a* includes magnet 560*a* positioned adjacent to first face 526*a*, magnet 562*a* positioned adjacent to second face 528*a*, magnet 564*a* positioned adjacent to third face 530*a*, and magnet 566*a* positioned adjacent to fourth face 532*a*. Similarly, polyhedrons 510*b-d* include at least one magnet positioned adjacent to each face.

As evident from the symbols in FIG. 5, the magnets positioned adjacent to hingedly connected faces have opposite polarities to enable magnetic coupling. For example, magnets 562*a* and *b* (positioned adjacent to the second faces 528*a, b*, respectively) have opposite polarities. Likewise, magnets 560*b, c* (both positioned adjacent to first faces 526*b, c*, respectively) have opposite polarities.

Furthermore, magnets positioned adjacent to corresponding (alike) faces of hingedly connected polyhedrons have opposite polarities, even if the faces are not hingedly connected directly. For example, magnets 564*a, b* are respectively positioned adjacent to third faces 530*a, b* and have opposite polarities. Similarly, magnets 566*a, b* are respectively positioned adjacent to fourth faces 532*a, b* and have opposite polarities.

In FIG. 5, each of the polyhedrons 510*a-d* has magnets of a single polarity. However, in other embodiments, at least some polyhedrons have magnets of both polarities, particularly if the polarity of each magnet is opposite to the polarity to the magnet of the corresponding face of the hingedly connected polyhedron. Accordingly, the arrangement shown in FIG. 5 is representative, not limiting.

Further, although FIG. 5 shows a single "+" or "−" symbol for each face of each of polyhedrons 510*a-d*, such symbol may represent more than one magnet, i.e., some embodiments include more than one magnet positioned adjacent to each face, e.g., two or three magnets per face. Such a configuration may increase the magnetic force between adjacent polyhedrons. In fact, it is possible for a single face of a single polyhedron to have magnets of both polarities, e.g., if each magnet has a polarity opposite to the polarity of a corresponding magnet on the adjacent hingedly connected polyhedron.

Although FIG. 5 shows that each polyhedron comprises a plurality of magnets, and that each face of each polyhedron has at least one magnet disposed adjacent to that face, the present disclosure contemplates that in some embodiments, some faces of some polyhedrons do not comprise any magnets positioned adjacent thereto. For example, in some embodiments, the polyhedrons 510*a-d* may omit magnets 560*a-d* (and/or magnets 562*a-d*, 564*a-d*, or 566*a-d*). For example, in some embodiments, one or more of polyhedrons 510*a-d* contains only a single magnet. Reducing the number of magnets can advantageously reduce manufacturing costs; however, reducing the number of magnets may compromise functionality.

In FIG. 5, the polyhedrons 510*a* and 510*c* can generally be considered "A type" polyhedrons and polyhedron 510*b* and 510*d* can be considered "B type" polyhedrons because the magnetic polarities of A-type and B-type polyhedrons attract each other. As shown, the transformation segment 500 is an ordered segment of ABAB polyhedrons.

The magnets may be disposed adjacent to the faces of the respective polyhedrons utilizing one or more different structures. In some embodiments, each magnet is disposed within an internal cavity formed by the outer shell of the polyhedron. In such embodiments, each magnet may be disposed adjacent to a face by adhering the magnet to that face, by fitting the magnet within a support or recess formed integrally with the face, by containing the magnet within a groove, track, or cradle formed integrally with an internal side of the face, or by other magnet positioning means. In some embodiments, the magnet is designed to move relative to its adjacent face, such as by moving within cradle or track. Representative structures for positioning magnets adjacent to faces include those described in U.S. Pat. Nos. 10,569,185 and 10,918,964 and U.S. Patent Publication No. US 2022/0047960, which are hereby incorporated by reference in their entireties.

Advantageously, the foregoing magnetic configurations enable geometric transformations of the present disclosure to be stabilized in the inverted configurations shown in FIGS. 1 and 6F as well as certain intermediate configurations (such as the intermediate configurations shown in FIGS. 6B-D. As a further benefit, the foregoing magnetic configurations, in combination with the geometry detailed in FIGS. 3A and 3B, enable magnetic and geometric compatibility with other geometric transformations such as those described in U.S. Pat. Nos. 10,569,185 and 10,918,964.

FIG. 6A-FIG. 6F illustrate one representative method of manipulating a transformation 600 of the present disclosure into a parallelepiped inverted configuration. The transformation 600 is the same as the geometric transformations of FIG. 1 and FIG. 2, and each of the polyhedrons 610*a*-1 has the geometry and hinged connections shown in FIG. 3A and FIG. 3B.

To assist understanding, the transformation 600 has the surface ornamentation arrangement shown in FIG. 4, although this characteristic is optional. Particularly, the transformation 600 is provided with three different surface ornamentations: first surfaces (exemplified by first surface 650 of polyhedron 610*d* bearing concentric circles); second surfaces (exemplified by second surface 652 of polyhedron 610*b* bearing parallel lines); and third surfaces (exemplified by third surface 654 of polyhedron 610*f* bearing parallel and perpendicular lines). Polyhedrons 610*a, g* have surface ornamentations corresponding to polyhedron 410*a* of FIG. 4; polyhedrons 610*b, h* have surface ornamentations corresponding to polyhedron 410*b* of FIG. 4; polyhedrons 610*c, i* have surface ornamentations corresponding to polyhedron 410*c* of FIG. 4; polyhedrons 610*d, j* have surface ornamentations corresponding to polyhedron 410*d* of FIG. 4; polyhedrons 610*e, k* have surface ornamentations corresponding to polyhedron 410*e* of FIG. 4; and polyhedrons 610*f*, 1 have surface ornamentations corresponding to polyhedron 410*f* of FIG. 4. Describing the following method with respect to different types of surface ornamentation (e.g., first surfaces, second surfaces, third surfaces) is intended to assist with understanding how the method may be adapted to achieve all three inverted configurations.

The following description provides a general method for configuring the transformation 600 into three different parallelepiped inverted configurations, wherein the outermost surfaces of each inverted configuration consists of either first surfaces 650, second surfaces 652, or third surfaces 654. To assist understanding, a specific method is also provided which configures the transformation 600 into a parallelepiped inverted configuration having outermost surfaces comprising (e.g., consisting of) second surfaces 652. However, the method can be readily adapted to configure the transformation 600 into parallelepiped inverted configurations having outermost surfaces comprising (e.g., consisting of) first surfaces 650 or third surfaces 654.

It shall be appreciated that the illustrated method is representative and not limiting. Persons skilled with the transformation segment 300 may achieve the inverted configuration shown in FIG. 6F utilizing fewer than all of the steps illustrated, and/or by combining certain steps.

In an optional first step shown in FIG. 6A, the transformation 600 is placed in the illustrated open loop configuration whereby diagonally opposed polyhedrons exhibit different surface ornamentations. For example, polyhedrons 610*a, b, g, h* exhibit second surfaces 652, whereas polyhedrons 610*e, f, k, l* exhibit third surfaces 654.

Next, the diagonally opposed polyhedrons exhibiting the same surface ornamentation are translated adjacent to each other, resulting in four adjacent triangular surfaces exhibiting the same surface ornamentation. In this example, polyhedron 610*a* is translated diagonally to abut polyhedron 610*h*, resulting in the configuration illustrated in FIG. 6B. Notably, the outermost surfaces of the resulting parallelepiped inverted configuration will comprise the second surfaces 652 exhibited on the diagonally opposed polyhedrons 610 *a, b, g, h*. Therefore, this step may be adapted such that the resulting inverted configuration exhibits a different surface ornamentation.

FIG. 6B shows the intermediate configuration resulting from the steps of FIG. 6A, which may be described as a three diamond configuration. The end polyhedrons are then rotated inwardly upon the corresponding penultimate polyhedrons to which the end polyhedrons are hingedly connected. In this example, polyhedron 610*j, k* are rotated inwardly upon polyhedrons 610*l, i*, respectively, and polyhedrons 610*d, e* are rotated inwardly upon polyhedrons 610*c, f*, respectively. This results in the configuration shown in FIG. 6C.

FIG. 6C shows the intermediate configuration resulting from the steps of FIG. 6B. In this intermediate configuration, transformation 600 has a longitudinal axis 656 and a latitudinal axis 658. On each side of the longitudinal axis 656, the transformation 600 has three apparent points (a central point and two outer points) comprising vertexes of one or more polyhedrons. The polyhedrons are then manipulated such that, on a first side of the longitudinal axis 656, the central point meets the outer point on a first side of the latitudinal axis 658. For example, the point of polyhedron 610*h* is brought together with the point of polyhedron 610*i*. The polyhedrons are further manipulated such that, on the second side of the longitudinal axis 656 (opposite to the first side), the central point meets the outer point on a second side of the latitudinal axis 658 (opposite to the first side). For example, the point of polyhedron 610*b* is brought together with the point of polyhedron 610*c*. This results in the configuration shown in FIG. 6D.

FIG. 6D shows the intermediate configuration resulting from the steps of FIG. 6C. A central vertex 660 disposed centrally between polyhedrons 610*a, b, g, h* is then lifted upward while rotating end points 662*a, b* downwardly.

FIG. 6E shows the intermediate configuration resulting from the step of FIG. 6D. As a final step to achieve a parallelepiped inverted configuration, end points 662*a, b* are brought together, resulting in the parallelepiped inverted configuration of FIG. 6F.

As shown in FIG. 6F, the resulting parallelepiped inverted configuration has outermost surfaces comprising (e.g., consisting of) second surfaces 652 (bearing parallel lines in this example). Restated, the first surfaces 650 and third surfaces 654 are concealed internally within the transformation 600 in the parallelepiped configuration shown. For the avoidance of doubt, the view shown in FIG. 6F is the same as the view of the opposite side of the transformation 600 (i.e., only second surfaces 652 shown). The foregoing method may be adapted such that the outermost surfaces of the parallelepiped consist of only second surfaces or third surfaces.

The foregoing description provides representative examples of geometric transformations which are configured to achieve three inverted configurations, optionally with surface ornamentation and/or magnetic features which complement the tripe inversions functionality.

What is claimed is:

1. A geometric transformation, comprising:

a transformation comprising a plurality of polyhedrons, wherein the plurality of polyhedrons consists of twelve polyhedrons hingedly connected in a loop and each of the polyhedrons comprises three different edge lengths, wherein the transformation is configurable between a first inverted configuration, a second inverted configuration, and a third inverted configuration, wherein the first inverted configuration, the second inverted configuration, and the third inverted configuration are congruent parallelepipeds.

2. The geometric transformation of claim 1, wherein each of the polyhedrons comprises one edge with an edge length of √(3) units, two edges with an edge length of √(2) units, and three edges with an edge length of one unit.

3. The geometric transformation of claim 2, wherein each of the polyhedrons comprises a magnet disposed adjacent to a face, wherein the magnets of adjacent polyhedrons in the loop have opposite polarities.

4. The geometric transformation of claim 1, wherein each other each of the polyhedrons comprises one edge with an edge length of √(3) units, one edge with an edge length of √(2) units, and one edge with an edge length of one unit.

5. The geometric transformation of claim 4, wherein each of the polyhedrons comprises a magnet disposed adjacent to a face, wherein the magnets of adjacent polyhedrons in the loop have opposite polarities.

6. The geometric transformation of claim 1, wherein each of the polyhedrons comprises a first face, a second face, a third face, and a fourth face, wherein each of the polyhedrons comprises a first magnet disposed adjacent to the first face, wherein the first magnets of adjacent polyhedrons have opposite polarities.

7. The geometric transformation of claim 6, wherein each of the polyhedrons comprises a second magnet disposed adjacent to the second face, wherein the second magnets of adjacent polyhedrons in the loop have opposite polarities.

8. The geometric transformation of claim 7, wherein each of the polyhedrons comprises a third magnet disposed adjacent to the third face, wherein the third magnets of adjacent polyhedrons in the loop have opposite polarities.

9. The geometric transformation of claim 8, wherein each of the polyhedrons comprises a fourth magnet disposed adjacent to the fourth face, wherein the fourth magnets of adjacent polyhedrons in the loop have opposite polarities.

10. The geometric transformation of claim 1, wherein:

outermost surfaces of the first inverted configuration are concealed internal surfaces in the second inverted configuration and the third inverted configuration, outermost surfaces of the second inverted configuration are concealed internal surfaces in the first inverted configuration and the third inverted configuration, and outermost surfaces of the third inverted configuration are concealed internal surfaces in the first inverted configuration and the second inverted configuration.

11. The geometric transformation of claim 1, wherein each of the polyhedrons comprises two incongruent faces.

12. The geometric transformation of claim 1, wherein:

outermost surfaces of the first inverted configuration consist of first surfaces, outermost surfaces of the second inverted configuration consist of second surfaces, outermost surfaces of the third inverted configuration consist of third surfaces, and the first surfaces, second surfaces, and third surfaces are mutually exclusive.

13. The geometric transformation of claim 1, wherein adjacent polyhedrons in the loop are mirror versions of each other.

14. The geometric transformation of claim 13, wherein each of the polyhedrons comprises a first edge and a second edge and is hingedly connected to a first adjacent polyhedron of the loop along the first edge and to a second adjacent polyhedron of the loop along the second edge, wherein the first edge is perpendicular to the second edge.

15. A geometric transformation, comprising:

a transformation comprising twelve polyhedrons sequentially and hingedly connected in a loop, wherein the transformation is configurable between a first parallelepiped, a second parallelepiped, and a third parallelepiped, wherein the first parallelepiped, the second parallelepiped, and the third parallelepiped are congruent, wherein outermost surfaces of the first parallelepiped consist of first surfaces, outermost surfaces of the second parallelepiped consist of second surfaces, outermost surfaces of the third parallelepiped consist of third surfaces, and the first surfaces, second surfaces, and third surfaces are mutually exclusive, wherein each of the polyhedrons comprises three different edge lengths and two incongruent faces.

16. The geometric transformation of claim 15, wherein each of the polyhedrons comprises one edge with an edge length of √(3) units, one edge with an edge length of √(2) units, and one edge with an edge length of one unit.

17. The geometric transformation of claim 16, wherein each of the polyhedrons comprises two edges with an edge length of √(2) units and three edges with an edge length of one unit.

18. The geometric transformation of claim 17, wherein each of the polyhedrons comprises a magnet disposed adjacent to a face, wherein the magnets of adjacent polyhedrons in the loop have opposite polarities.

19. A geometric transformation, comprising twelve polyhedrons sequentially and hingedly connected in a loop, wherein each of the polyhedrons comprises one edge with an edge length of √(3) units, one edge with an edge length of √(2) units, and one edge with an edge length of one unit, wherein each of the hingedly connected polyhedrons comprises a magnet disposed adjacent to a face, wherein the magnets of adjacent polyhedrons have opposite polarities, wherein the transformation is configured to be magnetically stabilized in a first parallelepiped, a second parallelepiped, and a third parallelepiped, wherein the first parallelepiped, the second parallelepiped, and the third parallelepiped are congruent.

20. The geometric transformation of claim 19, wherein each of the polyhedrons comprises two incongruent faces.

* * * * *